US005319284A

United States Patent [19]

Lee

[11] Patent Number: 5,319,284

[45] Date of Patent: Jun. 7, 1994

[54] ELECTRONIC BALLAST CIRCUIT FOR DISCHARGE LAMP

[76] Inventor: Sang-Woo Lee, 187-90 Yeonhee-Dong, Seodaemoon-Ku, Seoul, Rep. of Korea

[21] Appl. No.: 131,310

[22] Filed: Oct. 4, 1993

[30] Foreign Application Priority Data

Jul. 30, 1993 [KR] Rep. of Korea ..... 1993-14792

[51] Int. Cl.[5] ..... H05B 37/02

[52] U.S. Cl. ..... 315/209 R; 315/309; 315/307; 315/289; 315/290

[58] Field of Search ..... 315/309, 307, 209 R, 315/289, 290, 311

[56] References Cited

U.S. PATENT DOCUMENTS

| | | | |
|---|---|---|---|
| 3,334,270 | 8/1967 | Nuckolls | 315/171 |
| 4,181,872 | 1/1980 | Chermin | 315/224 X |
| 4,350,935 | 9/1982 | Spira et al. | 315/291 |
| 4,580,078 | 4/1986 | Spannhake | 315/8 |
| 4,890,041 | 12/1989 | Nuckolls et al. | 315/225 |
| 4,962,336 | 10/1990 | Dodd et al. | 315/290 |
| 5,023,516 | 6/1991 | Ito et al. | 315/101 |
| 5,049,788 | 9/1991 | Lee | 315/219 |
| 5,051,661 | 9/1991 | Lee | 315/225 |
| 5,122,712 | 6/1992 | Hirschmann | 315/106 |
| 5,208,515 | 5/1993 | Lee | 315/225 |

*Primary Examiner*—Paul Gensler
*Assistant Examiner*—Reginald A. Ratliff
*Attorney, Agent, or Firm*—Jones, Tullar & Cooper

[57] ABSTRACT

An electronic ballast circuit for a discharge lamp, comprising a plurality of transistors connected in series across a DC power line, a driving circuit for alternately turning on/off the transistors and a first LC series resonance circuit connected to an output of the driving circuit, the first LC series resonance circuit having a coil and a plurality of condensers. According to the invention, the electronic ballast circuit comprises a damping circuit connected across the coil for absorbing an instantaneously excessive preheating current or a high voltage pulse. The electronic ballast circuit also comprises a plurality of impulse voltage absorbing devices connected at their one sides to an output side of the coil and at their other sides to a high frequency zero potential point of the DC power line for absorbing a contact high voltage pulse generated across the discharge lamp. The electronic ballast circuit further comprises a second LC series resonance circuit connected across the discharge lamp for enhancing a crest factor of a current flowing through the discharge lamp. Therefore, filaments of the discharge lamp are not subjected to a damage resulting from a high crest factor current or a high voltage pulse. This results in an increase in the life of the discharge lamp.

4 Claims, 2 Drawing Sheets

ELECTRONIC BALLAST CIRCUIT FOR DISCHARGE LAMP

BACKGROUND OF THE INVENTION

1. Field of the Invention

The present invention relates in general to electronic ballast circuits for discharge lamps, and more particularly to an electronic ballast circuit for a discharge lamp which is capable of preventing blackening of the discharge lamp to lengthen the life of the discharge lamp.

2. Description of the Prior Art

In a discharge lamp of the cathode-preheating type such as a fluorescent lamp, an excessively large amount of preheating current may instantaneously be applied to both preheating cathode electrodes or filaments of the discharge lamp at the start of lighting of the discharge lamp, or a high voltage pulse may be applied to the filaments of the discharge lamp before normal preheating, as shown in FIG. 3A. Also, supply power across the discharge lamp must be turned on/off when the discharge lamp is to be replaced with a new one under the condition that it remains at its lighted state as an electronic ballast circuit therefor is operated. In this case, a contact high voltage pulse or spark may be generated across the discharge lamp, as shown in FIG. 4A. The high voltage pulse causes a thermion emitting material coated on the filaments such as a barium oxide to be broken away from the filaments, being evaporated or damaged. The thermion emitting material broken-away from the filaments causes a fluorescent material applied in the discharge lamp to be transformed resulting in blackening of the discharge lamp. The life of the discharge lamp is shortened due to the blackening. Moreover, the high voltage pulse exerts a bad influence on components in a circuit for lighting the discharge lamp, namely, damages the circuit components.

Referring to FIG. 1, there is shown a circuit diagram of a conventional electronic ballast circuit for a discharge lamp. In operation, upon application of a commercial alternating current (AC) power to a well-known rectifying circuit, a rectified direct current (DC) voltage from the rectifying circuit is applied across transistors Q1 and Q2 in different polarities. At this time, a high frequency current is generated from the transistors Q1 and Q2 and then flows to a LC series resonance circuit which is comprised of a coil L1 and condensers C1–C3. The high frequency current through the LC series resonance circuit is instantaneously applied by an excessively large amount to filaments H1 and H2 of the discharge lamp, as shown in FIG. 3A, resulting from a voltage multiplied by a Q value of the LC series resonance circuit. The instantaneously large amount of current results in generation of a very high pulse voltage multiplied by the Q value of the LC series resonance circuit across the condenser C1. As mentioned above, the filaments of the discharge lamp are subjected to the damage resulting from the high voltage pulse.

A non-sinusoidal wave or distorted wave current flows through the discharge lamp even upon application of a sinusoidal wave voltage across the discharge lamp because the discharge lamp has a negative resistance according to its natural characteristic. For this reason, the current flowing through the discharge lamp is high in crest factor even in the normal lighting of the discharge lamp, thereby causing the thermion emitting material coated on the filaments to be broken away from the filaments. The thermion emitting material broken-away from the filaments causes the fluorescent material applied in the discharge lamp to be transformed resulting in the blackening of the discharge lamp. As a result, the life of the discharge lamp is shortened due to the blackening.

SUMMARY OF THE INVENTION

Therefore, the present invention has been made in view of the above problem, and it is an object of the present invention to provide an electronic ballast circuit for a discharge lamp which is capable of preventing blackening of the discharge lamp to lengthen the life of the discharge lamp.

In accordance with the present invention, the electronic ballast circuit comprises a damping circuit connected across a coil of a first LC series resonance circuit for absorbing an instantaneously excessive preheating current or a high voltage pulse to prevent it from being applied across the discharge lamp.

The electronic ballast circuit also comprises impulse voltage absorbing devices or TNRs connected at their one sides to an output side of the coil of the first LC series resonance circuit and at their other sides to a high frequency zero potential point of a DC power line for absorbing a contact high voltage pulse generated across the discharge lamp in the case where supply power across the discharge lamp is turned on/off when the discharge lamp is to be replaced with a new one or at least one of a plurality of discharge lamps is to be removed under the condition that it remains at its lighted state as the ballast circuit is operated, to protect filaments of the discharge lamp from the contact high voltage pulse so as to lengthen the life of the discharge lamp.

The electronic ballast circuit further comprises a second LC series resonance circuit connected across the discharge lamp for enhancing a crest factor of a current flowing through the discharge lamp to prevent the filaments of the discharge lamp from being subjected to a damage resulting from a high crest factor current and, thus, a fluorescent material applied in the discharge lamp from being transformed.

BRIEF DESCRIPTION OF THE DRAWINGS

The above and other objects, features and advantages of the present invention will be more clearly understood from the following detailed description taken in conjunction with the accompanying drawings, in which:

FIGS. 4(*a*) and 4(*b*) are waveform diagrams of a current flowing through the discharge lamp in the case where supply power across the discharge lamp is turned on/off when the discharge lamp is to be replaced with a new one or at least one of a plurality of discharge lamps is to be removed under the condition that it remains at its lighted state as the ballast circuit is operated, in which:

DETAILED DESCRIPTION OF THE PREFERRED EMBODIMENT

Figure 1:
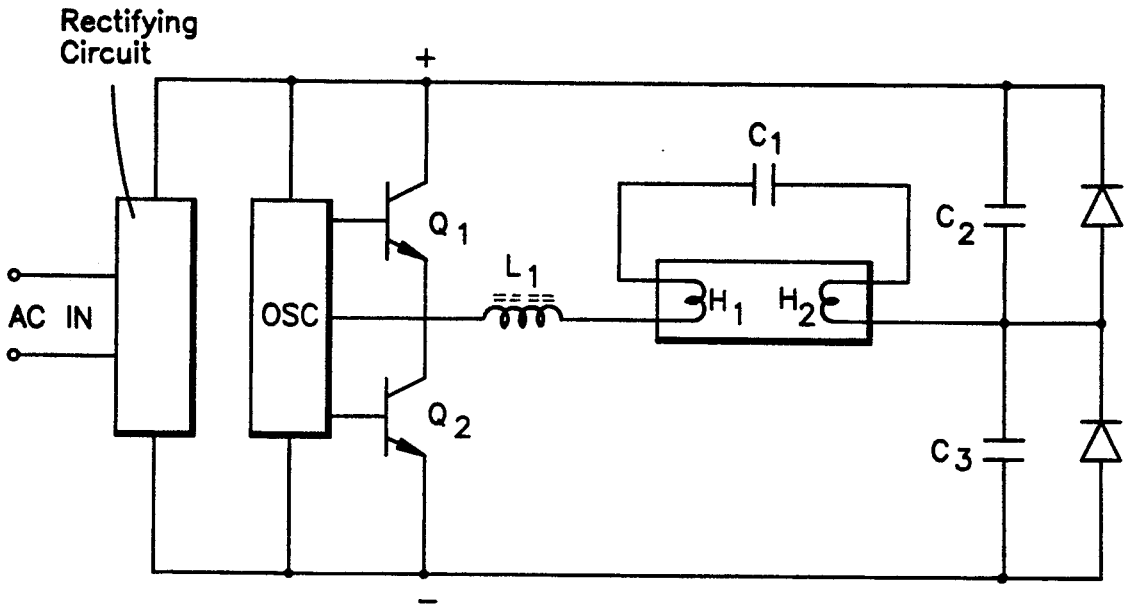
FIG. 1 is a circuit diagram of a conventional electronic ballast circuit for a discharge lamp.
Figure 2:
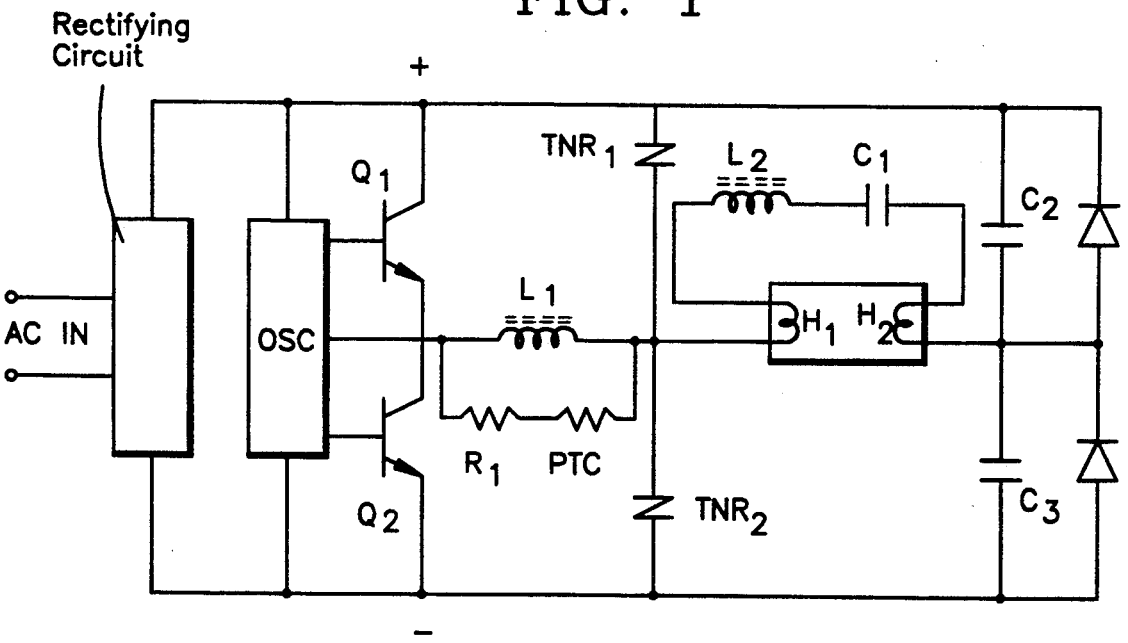
FIG. 2 is a circuit diagram of an electronic ballast circuit for a discharge lamp in accordance with the present invention.

Referring to FIG. 2, there is shown a circuit diagram of an electronic ballast circuit for a discharge lamp in accordance with the present invention. Some of parts in FIG. 2 are the same as those in FIG. 1. Therefore, like reference numerals designate like parts.

Conventionally, the electronic ballast circuit comprises a driving circuit OSC for alternately turning on/off the transistors Q1 and Q2 connected in series across a DC power line. The first LC series resonance circuit is connected to an output of the driving circuit OSC. The first LC series resonance circuit includes the coil L1 and the condensers C1–C3, as mentioned previously with reference to FIG. 1.

In accordance with the present invention, the electronic ballast circuit comprises a damping circuit connected across the coil L1 of the first LC series resonance circuit, impulse voltage absorbing devices TNR1 and TNR2 connected at their one sides to an output side of the coil L1 of the first LC series resonance circuit and at their other sides to a high frequency zero potential point of the DC power line, and a second LC series resonance circuit connected across the discharge lamp. The damping circuit includes a resistor R1 and a positive temperature coefficient (PTC) thermistor. The second LC series resonance circuit includes the condenser C1 of the first LC series resonance circuit connected across the discharge lamp and a coil L2 connected to the condenser C1.

Figure 3A:
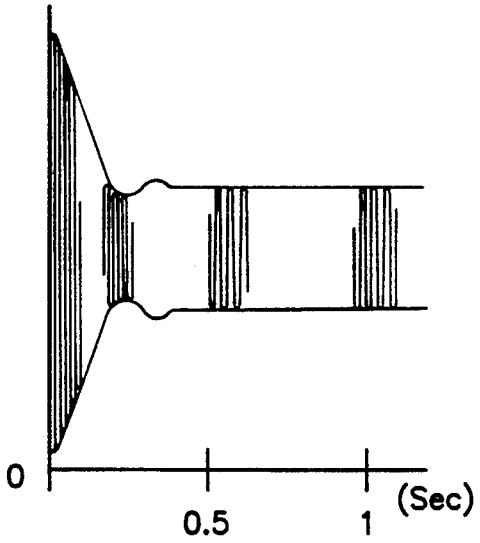
FIG. 3(a) PRIOR ART
FIG. 3A is a waveform diagram of a discharge lamp start current in accordance with the prior art.
Figure 3B:
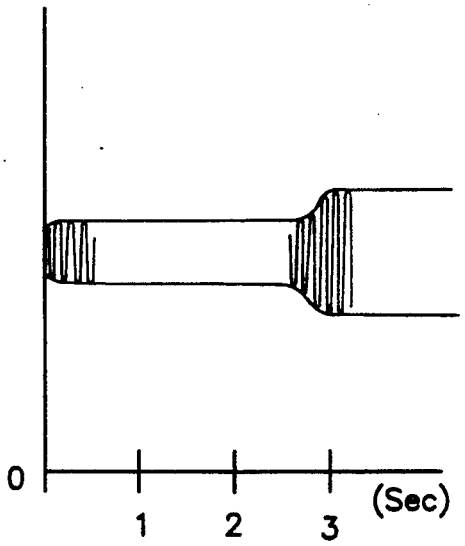
FIG. 3B is a waveform diagram of a discharge lamp start current in accordance with the present invention.

The damping circuit acts to absorb the excessively large amount of impulse current appearing at the start of the lighting of the discharge lamp as shown in FIG. 3A. Therefore, with the use of the damping circuit, the current applied to the discharge lamp is small in amount at the start of the lighting of the discharge lamp as shown in FIG. 3B.

The PTC thermistor in the damping circuit is a PTC variable resistor with a resistance increased as a self-temperature rises. At the start of the lighting of the discharge lamp or upon turning on a power switch (not shown), the output current from the transistors Q1 and Q2 flows through the series damping circuit of the resistor R1 and the PTC thermistor and through the first series LC resonance circuit of the coil L1 and the condensers C1–C3. Since the damping circuit is connected in parallel to the coil L1 of the first LC series resonance circuit, the Q value of the coil L1 becomes very low at the start of the lighting of the discharge lamp, thereby causing a resonance frequency of the first series LC resonance circuit to become very high. As a result, a very small amount of current is applied to the filaments of the discharge lamp as shown in FIG. 3B.

Thereafter, as the current from the transistors Q1 and Q2 flows through the resistor R1 and the PTC thermistor of the damping circuit, heat is generated in the resistor R1 and the PTC thermistor. The heat in the resistor R1 and the PTC thermistor is increased in amount with the lapse of time. The resistance of the PTC thermistor is increased with the increase in the amount of the heat. As a result, the Q value of the coil L1 reaches its natural characteristic value according to the proportional characteristic (with the lapse of time). In other words, in the case where the damping circuit (R1+PTC) is not present, the instantaneous inrush current is applied to the filaments of the discharge lamp at the moment that the power switch is turned on, and is then reduced gradually to a normal amount, as shown in FIG. 3A. On the contrary, according to the present invention, in the case where the damping circuit (R1+PTC) is present, the very small amount of current is applied to the filaments of the discharge lamp at the moment that the power switch is turned on, and is then increased gradually to the normal amount, as shown in FIG. 3B.

Figure 4A:
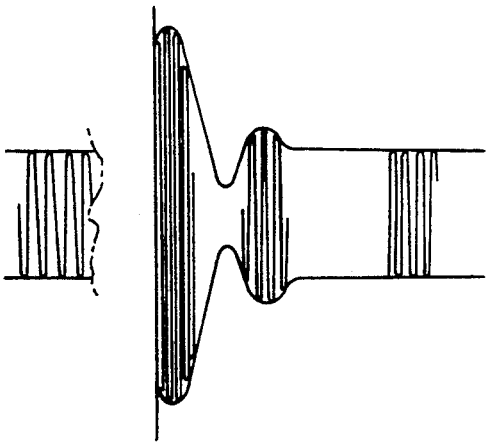
FIG. 4(a) PRIOR ART
FIG. 4A is a waveform diagram of the current flowing through the discharge lamp in accordance with the prior art.
Figure 4B:
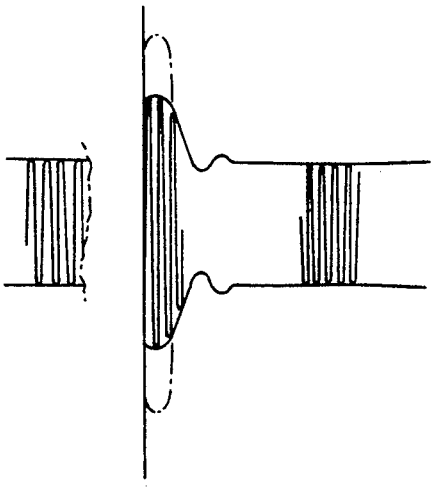
FIG. 4B is a waveform diagram of the current flowing through the discharge lamp in accordance with the present invention.

The impulse voltage absorbing devices TNR1 and TNR2 are connected at their one sides to the output side of the coil L1 of the first LC series resonance circuit and at their other sides to the high frequency zero potential point of the DC power line, to absorb the contact high voltage pulse, as shown in FIG. 4A, generated across the discharge lamp in the case where supply power across the discharge lamp is turned on/off when the discharge lamp is to be replaced with a new one or at least one of a plurality of discharge lamps is to be removed under the condition that it remains at its lighted state as the ballast circuit is operated. The impulse voltage absorbing devices TNR1 and TNR2 lowers a level of the contact high voltage pulse as shown in FIG. 4A to that as shown in FIG. 4B by absorbing it earlier than the first LC series resonance circuit of the coil L1 and the condensers C1–C3. Therefore, the use of the impulse voltage absorbing devices TNR1 and TNR2 has the effect of protecting the transistors Q1 and Q2 and the filaments of the discharge lamp from the contact high voltage pulse.

The coil L2 is connected to the condenser C1 connected across the discharge lamp to enhance the crest factor of the current flowing through the discharge lamp. Although the condenser C1 is connected across the discharge lamp to make the lighting of the discharge lamp easy, it is a major cause of distorting a waveform of the current flowing through the discharge lamp. The high frequency current to the discharge lamp flows through the coil L1, the discharge lamp and the condensers C2 and C3 and also to the condenser C1 of an auxiliary lighting circuit. Of course, a main current flows through the discharge lamp; however, an amount of current, not negligible, flows through the auxiliary lighting circuit of the filaments H1 and H2 and the condenser C1. At this time, the condenser C1 distorts the waveform of the current flowing through the discharge lamp according to its natural characteristic. This distortion is a major cause of making the crest factor of the current flowing through the discharge lamp high. To solve this problem, according to the present invention, the coil L2 is connected in series to the condenser C1 to form the series resonance circuit making an impedance of the condenser C1 and the coil L2 very high. This construction reduces the bad influence of the condenser C1 on the current flowing through the discharge lamp. Therefore, the crest factor of the current flowing through the discharge lamp is enhanced so that the filaments of the discharge lamp can be prevented from being subjected to the damage resulting from the high crest factor. In result, the life of the discharge lamp can be lengthened.

As apparent from the above description, according to the present invention, the damping circuit is provided to prevent the instantaneously excessive preheating current or the high voltage pulse from being applied across the discharge lamp. Also, the impulse voltage absorbing devices are provided to absorb the contact high voltage pulse generated across the discharge lamp in the case where the supply power across the discharge lamp is turned on/off when the discharge lamp is to be replaced with a new one or at least one of a plurality of discharge lamps is to be removed. Further, the second LC series resonance circuit is provided to enhance the crest factor of the current flowing through the discharge lamp. Therefore, the filaments of the discharge lamp are not subjected to the damage resulting from the high crest factor current or the high voltage pulse. This results in an increase in the life of the discharge lamp.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electronic ballast circuit for a discharge lamp, comprising a plurality of transistors connected in series across a DC power line, a driving circuit for alternately turning on/off said transistors and a first LC series resonance circuit connected to an output of said driving circuit, said first LC series resonance circuit having a first coil and first to third condensers, said first condenser of said first LC series resonance circuit being connected across the discharge lamp, wherein the improvement comprises:

a damping circuit connected across said first coil of said first LC series resonance circuit, said damping circuit having a resistor and a positive temperature coefficient thermistor connected in series across said first coil of said first LC series resonance circuit.

2. An electronic ballast circuit for a discharge lamp, as set forth in claim 1, further comprising:

a plurality of impulse voltage absorbing means connected at their one sides to an output side of said first coil of said first LC series resonance circuit and at their other sides to a high frequency zero potential point of the DC power line.

3. An electronic ballast circuit for a discharge lamp, as set forth in claim 1, further comprising:

second LC series resonance circuit connected across the discharge lamp, said second LC series resonance circuit having said first condenser of said first LC series resonance circuit and a second coil connected in series to said first condenser.

4. An electronic ballast circuit for a discharge lamp, as set forth in claim 2, further comprising:

second LC series resonance circuit connected across the discharge lamp, said second LC series resonance circuit having said first condenser of said first LC series resonance circuit and a second coil connected in series to said first condenser.

* * * * *